US010018159B2

(12) United States Patent
Akita et al.

(10) Patent No.: US 10,018,159 B2
(45) Date of Patent: Jul. 10, 2018

(54) FUEL VAPOR PROCESSING APPARATUS

(71) Applicant: AISAN KOGYO KABUSHIKI KAISHA, Obu-shi, Aichi-ken (JP)

(72) Inventors: Minoru Akita, Ama (JP); Yoshikazu Miyabe, Obu (JP); Naoyuki Tagawa, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 168 days.

(21) Appl. No.: 14/542,171

(22) Filed: Nov. 14, 2014

(65) Prior Publication Data

US 2015/0144111 A1 May 28, 2015

(30) Foreign Application Priority Data

Nov. 25, 2013 (JP) ..... 2013-243006

(51) Int. Cl.
*F02M 25/08* (2006.01)
*F02D 41/00* (2006.01)
(Continued)

(52) U.S. Cl.
CPC ..... *F02M 25/0836* (2013.01); *F02D 41/004* (2013.01); *F02D 41/0045* (2013.01);
(Continued)

(58) Field of Classification Search
CPC ..... F02M 25/0836; F02M 2025/0845; F02M 25/0872; F02M 25/0818; F02D 41/004; F02D 41/0045
(Continued)

(56) References Cited

U.S. PATENT DOCUMENTS 5,497,757 A * 3/1996 Osanai ..... F02M 25/08 123/674
5,605,177 A * 2/1997 Ohashi ..... B60K 15/03519 123/516
(Continued)

FOREIGN PATENT DOCUMENTS

DE 19838959 A1 3/2000
DE 102010014558 A1 10/2011
(Continued)

OTHER PUBLICATIONS

German Patent Application No. DE 10 2014 017 158.2 Office Action dated Jun. 16, 2015 (7 pages).
(Continued)

*Primary Examiner* — Hai Huynh
*Assistant Examiner* — Gonzalo Laguarda
(74) *Attorney, Agent, or Firm* — Conley Rose, P.C.

(57) ABSTRACT

A fuel vapor processing apparatus may include a canister capable of adsorbing fuel vapor produced in a fuel tank, a closing valve provided in a vapor passage connecting the canister and the fuel tank, a purge passage connecting the canister and an intake passage of an engine, and a control device. The closing valve may include a movable valve member movable along a linear path and an actuator coupled to the movable valve member. The control device may be coupled to the actuator and may be configured to control the actuator such that the position of the movable valve member along the linear path changes according to a deviation of an actual tank internal pressure of the fuel tank from a target tank internal pressure.

10 Claims, 8 Drawing Sheets

(51) Int. Cl.
*F02D 41/24* (2006.01)
*F02D 41/14* (2006.01)

(52) U.S. Cl.
CPC ..... *F02M 25/0872* (2013.01); *F02D 41/2451* (2013.01); *F02D 2041/1422* (2013.01); *F02M 2025/0845* (2013.01)

(58) Field of Classification Search
USPC ..... 123/519, 520, 457; 73/114.39, 114.42
See application file for complete search history.

(56) References Cited

U.S. PATENT DOCUMENTS

| | | | | |
|---|---|---|---|---|
| 5,979,160 | A * | 11/1999 | Yashiki | F01N 11/007 60/276 |
| 6,003,499 | A * | 12/1999 | Devall | F02M 25/0836 123/516 |
| 6,357,288 | B1 * | 3/2002 | Shigihama | F02M 25/0809 73/114.39 |
| 8,607,765 | B2 | 12/2013 | Hagen | |
| 8,622,088 | B2 | 1/2014 | Sugiura et al. | |
| 2002/0029768 | A1 * | 3/2002 | Matsubara | F02D 41/0045 123/500 |
| 2002/0088441 | A1 * | 7/2002 | Weldon | F02M 25/0836 123/520 |
| 2011/0203554 | A1 | 8/2011 | Horiba et al. | |
| 2011/0296997 | A1 | 12/2011 | Sugiura | |
| 2012/0211687 | A1 | 8/2012 | Benjey et al. | |
| 2014/0102420 | A1 | 4/2014 | Kimoto et al. | |
| 2016/0076493 | A1 * | 3/2016 | Koller | F02M 25/0836 251/279 |

FOREIGN PATENT DOCUMENTS

| | | | |
|---|---|---|---|
| DE | 102013016984 | A1 | 4/2014 |
| JP | 05-33729 | A | 2/1993 |
| JP | 08-74678 | A | 3/1996 |
| JP | 10-299583 | A | 11/1998 |
| JP | 10-299586 | A | 11/1998 |
| JP | 2004-156496 | A | 6/2004 |
| JP | 2004-308483 | A | 11/2004 |
| JP | 2005-155323 | A | 6/2005 |
| JP | 2010-281258 | A | 12/2010 |
| JP | 2011-144848 | A | 7/2011 |
| JP | 2011-169276 | A | 9/2011 |
| JP | 2011-256778 | A | 12/2011 |
| JP | 2013-104316 | A | 5/2013 |
| JP | 2013-113198 | A | 6/2013 |

OTHER PUBLICATIONS

Japanese Patent Application No. 2013-243006 Notification of Reasons for Refusal dated Jan. 17, 2017 (7 pages).

* cited by examiner

| SenP (kPa) | 0 | ----- | 5 | ----- | 20 |
|---|---|---|---|---|---|
| Kp | 0.5 | ----- | 0.2 | ----- | 0.05 |

A/F CORRECTION

| A/F_F/B (%) | $-\alpha$ | 0 | $\alpha$ |
|---|---|---|---|
| A/F CORRETION VALUE (Step) | −1 | 0 | 1 |

FUEL VAPOR PROCESSING APPARATUS

CROSS-REFERENCE TO RELATED APPLICATIONS

This application claims priority to Japanese patent application serial number 2013-243006, filed Nov. 25, 2013, the contents of which are incorporated herein by reference in their entirety for all purposes.

STATEMENT REGARDING FEDERALLY SPONSORED RESEARCH OR DEVELOPMENT

Not applicable.

BACKGROUND

Embodiments of the present disclosure relate to fuel vapor processing apparatus that may include a canister for adsorbing fuel vapor generated in a fuel tank, a closing valve provided in a vapor passage connecting the canister and the fuel tank to each other, and a purge passage connecting the canister and the intake passage of an engine.

JP-A-2005-155323 discloses a fuel vapor processing apparatus that may include a canister for adsorbing fuel vapor generated in a fuel tank, a closing valve provided in a vapor passage connecting the canister and the fuel tank to each other, and a purge passage connecting the canister and the intake passage of an engine.

In the fuel vapor processing apparatus of this document, if a predetermined purge condition is satisfied after driving of the engine, the interior of the canister may be brought to communicate with the atmosphere. In this state, the intake negative pressure of the engine may be applied to the interior of the canister via the purge passage. As a result, the atmospheric air may flow into the canister to desorb the fuel vapor adsorbed by the adsorbent. The fuel vapor desorbed from the adsorbent may be introduced into the engine via the purge passage. Further, while the purge operation is performed for the canister, the closing valve of the vapor passage may be opened for a depressurization control of the fuel tank.

Here, the closing valve used in the fuel vapor processing apparatus may be opened when an ON-signal is received from an ECU and may be closed when an OFF-signal is received from the ECU. A duty ratio control may be performed on the ON-signal and the OFF-signal from the ECU, whereby the flow rate of the gas flowing through the closing valve is adjusted for the depressurization control of the fuel tank.

In the above-described fuel vapor processing apparatus, the flow rate (depressurization flow rate) of the gas flowing through the closing valve is adjusted under the duty ratio control, whereby the depressurization control is performed for the fuel tank. However, due to the duty ratio control, the closing valve is periodically turned ON and OFF to periodically repeat the fully opened state and the fully closed state of the valve in order to adjust the average flow rate per unit time of the gas flowing through the closing valve. Therefore, it is difficult to perform fine adjustment of the flow rate. As a result, the depressurization control may not be accurately performed.

Therefore, there has been a need in the art for making it possible to accurately perform a depressurization control for the fuel tank.

SUMMARY

In one aspect according to the present teachings, a fuel vapor processing apparatus may include a canister capable of adsorbing fuel vapor produced in a fuel tank, a closing valve provided in a vapor passage connecting the canister and the fuel tank, a purge passage connecting the canister and an intake passage of an engine, and a control device. The closing valve may include a movable valve member movable along a linear path and an actuator coupled to the movable valve member. The control device may be coupled to the actuator and may be configured to control the actuator such that the position of the movable valve member along the linear path changes according to a deviation of an actual tank internal pressure of the fuel tank from a target tank internal pressure.

DETAILED DESCRIPTION

Figure 1:
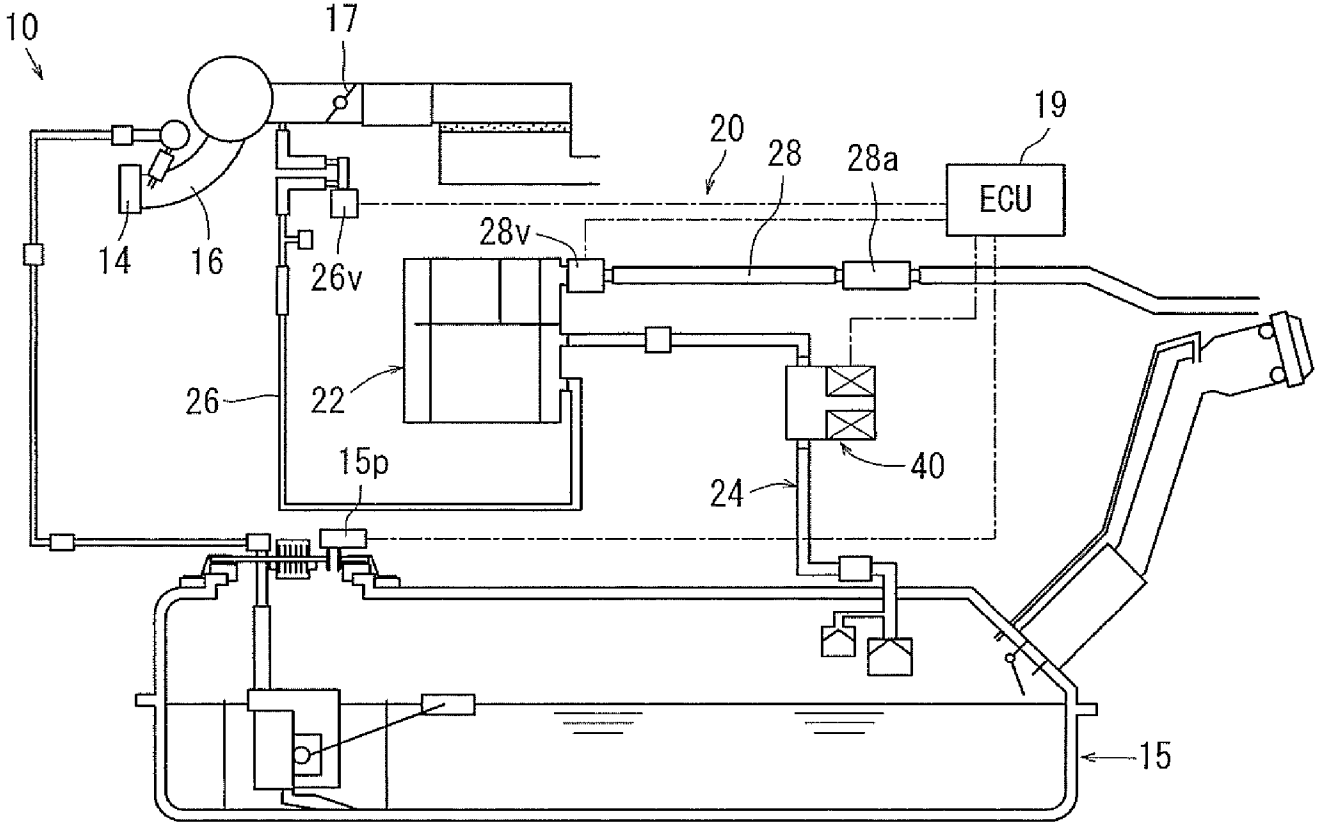
FIG. 1 is a schematic view illustrating the general construction of a fuel vapor processing apparatus according to a first embodiment.

Each of the additional features and teachings disclosed above and below may be utilized separately or in conjunction with other features and teachings to provide improved fuel vapor processing apparatus. Representative examples which utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples. Moreover, various features of the representative examples and the dependent claims may be combined in ways that are not specifically enumerated in order to provide additional useful examples of the present teachings.

In one embodiment, a fuel vapor processing apparatus may include a canister capable of adsorbing fuel vapor produced in a fuel tank, a closing valve provided in a vapor passage connecting the canister and the fuel tank, and a purge passage connecting the canister and an intake passage of an engine. The closing valve may include a valve seat, a movable valve member movable relative to the valve seat in an axial direction, and an actuator coupled to the movable valve member. A control device may be coupled to the actuator and configured to perform a depressurization control, in which a stroke distance of the movable valve member of the closing valve in the axial direction is changed with respect to a reference position, so that a flow rate of a gas flowing through the vapor passage is adjusted to reduce a pressure within the fuel tank. The depressurization control may include a feedback control of the stroke distance of the movable valve member of the closing valve such that a deviation of an actual tank internal pressure from a target tank internal pressure of the fuel tank becomes smaller.

Therefore, if the actual tank internal pressure is higher than the target tank internal pressure, the stroke distance may be adjusted in a direction for opening the closing valve. Therefore, fuel vapor containing gas produced within the fuel tank may be released to flow toward the canister, so that depressurization of the fuel tank may be performed. Because the depressurization of the fuel tank is performed through the feedback control, a complicated control is not necessary.

The closing valve may be configured such that the movable valve member contacts the valve seat to close the closing valve for keeping the fuel tank in a closed state when the stroke distance is between zero and a predetermined value. The movable valve member may be positioned at a valve open start position when the stroke distance is the predetermined value. If the deviation of the actual tank internal pressure from the target tank internal pressure of the fuel tank is within a predetermined range, the control device may set the stroke distance to a value that is larger than zero and smaller than the predetermined value for the valve open start position, so that the movable valve member may be positioned at a standby position for keeping the fuel tank in the closed state.

With this arrangement, if the deviation of the actual tank internal pressure from the target tank internal pressure of the fuel tank is within the predetermined range, the closing valve may be kept at the standby position for keeping the fuel tank in the closed state. Therefore, in this case, no feedback control may be performed. This may prevent the depressurization control from being performed in the event that a fine change in the tank internal pressure is caused due to fluctuation in the liquid level in the fuel tank. In addition, because the closing valve can be kept in the vicinity of the valve opening start position, it is possible to quickly open the closing valve when the feedback control is necessary to be performed.

The stroke distance of the movable valve member of the closing valve may be set based on a value obtained by multiplying the deviation of the actual tank internal pressure from the target tank internal pressure by a constant. The value of the constant may be large if the actual tank internal pressure is small, while the value of the constant may be small if the actual tank internal pressure is large.

If the opening degree of the closing valve is the same, the flow rate of the gas flowing through the closing valve when the tank internal pressure is high may be larger than the flow rate of the gas flowing through the closing valve when the tank internal pressure is low. By setting the valve of the constant to be small if the tank internal pressure is high, the change in the stroke distance (valve opening degree) of the closing valve at the time of feedback control may be small, making it possible to reduce the change of the flow rate of the gas through the closing valve. Conversely, by setting the value of the constant to be large if the tank internal pressure is low, the change in the stroke distance (valve opening degree) of the closing valve may be large, making it easy for the gas to flow through the closing valve. In this way, the gas may flow through the closing valve in the same manner irrespective of whether the tank internal pressure is high or low, and the depressurization control for the fuel tank may be performed substantially in the same manner irrespective of whether the tank internal pressure is high or low.

The feedback control may be performed when the purge passage connecting the canister and the intake passage of the engine is being opened. The movable valve member of the closing valve may be kept at a standby position for keeping the fuel tank in the closed state when the purge passage connecting the canister and the intake passage of the engine is being closed.

In this way, the depressurization control of the fuel tank may not be performed when the purge passage is being closed. Therefore, the canister may not be filled up with fuel vapor flown from the fuel tank.

The stroke distance may be determined not to exceed an upper limit value, so that the flow rate of the gas flowing through the closing valve does not exceed a purge flow rate of the gas flowing through the purge passage connecting the canister and the intake passage of the engine. Therefore, the fuel vapor having flown into the canister from the fuel tank via the vapor passage may not stay in the canister but may be introduced into the intake passage of the engine via the purge passage.

The control device may be further configured to correct the stroke distance of the movable valve member according to an air-fuel ratio of the engine. If, for example, the air-fuel ratio of the engine is too rich, the stroke distance of the closing valve may be corrected to reduce the opening degree of the closing valve, making it possible to reduce the amount of the fuel vapor supplied to the intake passage of the engine from the fuel tank via the vapor passage, the canister, and the purge passage. Conversely, if the air-fuel ratio is too lean, the stroke distance of the closing valve may be corrected to increase the opening degree of the closing valve, making it possible to increase the amount of the fuel vapor supplied to the intake passage of the engine from the fuel tank via the vapor passage, the canister, and the purge passage. As a result, it is possible to maintain the air-fuel ratio of the engine at an appropriate level.

First Embodiment

A fuel vapor processing apparatus 20 according to a first embodiment will now be described with reference to FIGS. 1 through 6. As shown in FIG. 1, the fuel vapor processing apparatus 20 may be provided in a vehicle engine system 10. The fuel vapor processing apparatus 20 may be configured to prevent leakage to the exterior of fuel vapor generated in a fuel tank 15 of the vehicle.

As shown in FIG. 1, the fuel vapor processing apparatus 20 may generally include a canister 22, a vapor passage 24 connected to the canister 22, a purge passage 26, and an atmospheric passage 28.

The canister 22 may be filled with activated carbon (not shown) serving as an adsorbent that can adsorb fuel vapor produced in the fuel tank 15.

One end portion (upstream side end portion) of the vapor passage 24 may communicate with a gaseous space inside the fuel tank 15, and the other end portion (downstream side end portion) of the vapor passage 24 may communicate with the interior of the canister 22. At a point along the vapor passage 24, there may be provided a closing valve 40 capable of allowing and prohibiting communication through the vapor passage 24. As will be explained later, the closing valve 40 may be configured as a flow control valve capable of adjusting a flow rate of gas flowing through the closing valve 40.

One end portion (upstream side end portion) of the purge passage 26 may communicate with the interior of the canister 22, and the other end portion (downstream side end portion) of the purge passage 26 may communicate with an intake passage 16 at a position on the downstream side of a throttle valve 17. At a point along the purge passage 26, there may be provided a purge valve 26*v* capable of allowing and prohibiting communication through the purge passage 26.

Further, the canister 22 may communicate with the atmospheric passage 28 via an OBD (On-board diagnostics) component 28*v* for failure detection. At a point along the atmospheric passage 28, there may be provided an air filter 28*a*. The other end portion of the atmospheric passage 28 may be opened to the atmosphere.

The closing valve 40, the purge valve 26*v*, and the OBD component 28*v* may be controlled according to control signals outputted from an ECU (engine control unit) 19.

The ECU 19 may receive inputs such as a signal from a tank internal pressure sensor 15*p* for detecting the internal pressure of the fuel tank 15.

Next, the basic operation of the fuel vapor processing apparatus 20 will be described. While the vehicle is parking, i.e. while the vehicle engine is stopped, the closing valve 40 may be kept in the closed state. Thus, no fuel vapor in the fuel tank 15 flows into the canister 22. When an ignition switch of the vehicle is turned on while the vehicle is parking, a learning control may be performed in order to learn a valve opening start position for the closing valve 40. Further, while the vehicle is parking, the purge valve 26*v* may be kept in the closed state, so that the purge passage 26 may be in the closed state, with the atmospheric passage 28 being kept in the communication state.

While the vehicle is traveling, if a predetermined purge condition is satisfied, a control operation may be performed in which the fuel vapor adsorbed by the canister 22 is purged under the control of the ECU 19. In this control operation, the purge valve 26*v* may be controlled to open or close while allowing the canister 22 to communicate with the atmosphere via the atmospheric passage 28. When the purge valve 26*v* is opened, the intake negative pressure of the engine 14 may be applied to the interior of the canister 22 via the purge passage 26. As a result, the atmospheric air may flow into the canister 22 via the atmospheric passage 28. Further, when the purge valve 26*v* is opened, the closing valve 40 may operate in the valve opening direction to perform a depressurization control for the fuel tank 15. Therefore, the gas (air containing fuel vapor) in the fuel tank 15 may flow into the canister 22 via the vapor passage 24. As a result, the adsorbent in the canister 22 may be purged by the air, etc. flowing into the canister 22. The fuel vapor desorbed from the adsorbent may be introduced into the intake passage 16 of the engine 14 together with the air and may be then burnt in the engine 14.

Figure 2:
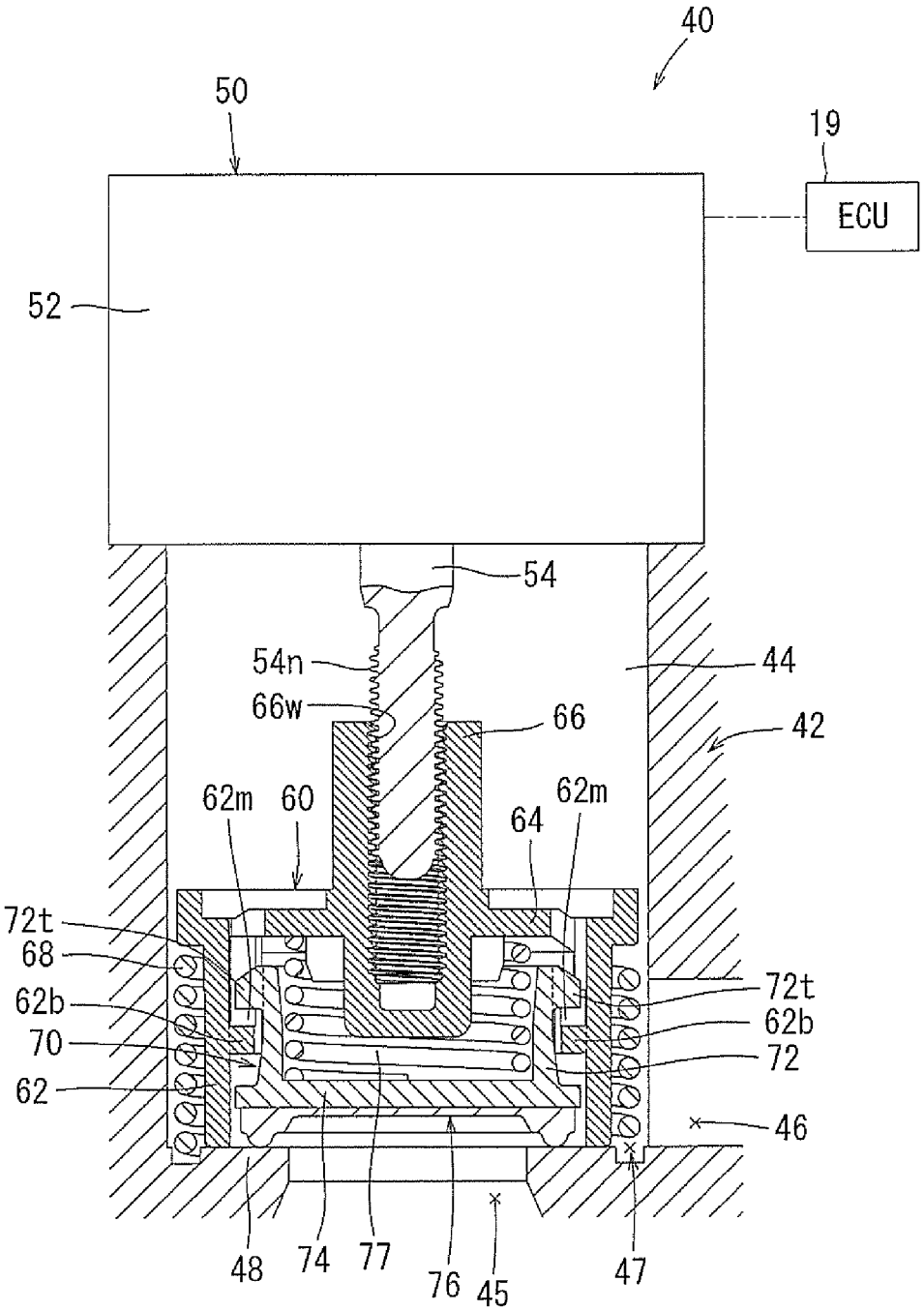
FIG. 2 is a vertical sectional view illustrating an initialized state of a closing valve used in the fuel vapor processing apparatus.

The closing valve 40 may be a flow control valve configured to close the vapor passage 24 in the closed state, and to adjust the flow rate of the gas flowing through the vapor passage 24 in the open state. As shown in FIG. 2, the closing valve 40 may include a valve casing 42, a stepping motor 50, a valve guide 60, and a valve body 70.

In the valve casing 42, there may be defined a continuous, inversed L-shaped fluid passage 47 by a valve chamber 44, an inflow passage 45, and an outflow passage 46. A valve seat 48 may be formed concentrically on the lower surface of the valve chamber 44, that is, at the open edge portion of the upper end opening of the inflow passage 45.

The stepping motor 50 may be mounted to the upper portion of the valve casing 42. The stepping motor 50 may have a motor main body 52 and an output shaft 54. The output shaft 54 may protrude from the lower surface of the motor main body 52 and may be rotatable in a normal direction and a reverse direction. The output shaft 54 may be concentrically arranged within the valve chamber 44 of the valve casing 42. A male thread portion 54*n* may be formed on the outer circumferential surface of the output shaft 54.

The valve guide 60 may be formed as a cylindrical tube with a closed top. The valve guide 60 may include a cylindrical tubular wall portion 62 and an upper wall portion 64 closing the upper end opening of the tubular wall portion 62. At the central portion of the upper wall portion 64, there may be concentrically formed a tubular shaft portion 66. A female thread portion 66*w* may be formed on the inner circumferential surface of the tubular shaft portion 66. The valve guide 60 may be arranged so as to be movable in the axial direction (vertical direction) while prohibited from rotating about the axis by a suitable rotation preventing device (not shown).

The male thread portion 54*n* of the output shaft 54 of the stepping motor 50 may be engaged with the female thread portion 66*w* of the tubular shaft portion 66 of the valve guide 60. Therefore, as the output shaft 54 of the stepping motor 54 rotates in the normal direction, the valve guide 60 may be raised in the vertical direction (axial direction). On the other hand, as the output shaft 54 of the stepping motor 50 rotates in the reverse direction, the valve guide 60 may be lowered in the vertical direction (axial direction).

Around the valve guide 60, there may be provided an auxiliary spring 68 for urging the valve guide 60 upwardly.

The valve body 70 may be formed as a cylindrical tube with a closed bottom. The valve body 70 may include a cylindrical tubular wall portion 72 and a lower wall portion 74 closing the lower end opening of the tubular wall portion 72. A seal member 76 may be a disc-like member formed of an elastic material such as a rubber. The seal member 76 may be attached to the lower surface of the lower wall portion 74.

The valve body 70 may be concentrically arranged within the valve guide 60. The seal member 76 of the valve body 70 may be arranged so as to be capable of contacting the upper surface of the valve seat 48 of the valve casing 42. A plurality of connection protrusions 72*t* may be formed in the circumferential direction on the outer circumferential surface of the upper end portion of the tubular wall portion 72 of the valve body 70. The plurality of connection protrusions 72*t* of the valve body 70 may be fitted with a plurality of vertical-groove-like connection recesses 62*m* formed in the inner circumferential surface of the tubular wall portion 62 of the valve guide 60 in such a manner that the valve body 70 can move relative to the valve guide 60 by a given distance in the vertical direction. The valve guide 60 and the valve body 70 can move together upwards (in the valve opening direction), with bottom wall portions 62*b* of the connection recesses 62*m* of the valve guide 60 contacting the connection protrusions 72*t* from below.

Further, a valve spring 77 may normally urge the valve body 70 downwards, i.e., in the valve closing direction, with respect to the valve guide 60. The valve spring 77 may be concentrically arranged between the upper wall portion 64 of the valve guide 60 and the lower wall portion 74 of the valve body 70.

Next, the basic operation of the closing valve 40 will be described. The stepping motor 50 of the closing valve 40 may rotate in the valve opening direction or in the valve closing direction by a predetermined number of steps according to an output signal (described below) from the ECU 19. As a result of rotation of the stepping motor 50 by the predetermined steps, the valve guide 60 may move by a predetermined stroke distance in the vertical direction through threaded engagement between the male thread portion 54*n* of the output shaft 54 of the stepping motor 50 and the female thread portion 66*w* of the tubular shaft portion 66 of the valve guide 60. In this way, the valve guide 60 may move in the vertical direction along a linear path.

The closing valve 40 may be set, for example, such that, at the fully opened position, the number of steps is approximately 200 and the stroke distance is approximately 5 mm.

As shown in FIG. 2, in the initialized state (initial state) of the closing valve 40, the valve guide 60 may be held at the lower limit position where the lower end surface of the tubular wall portion 62 of the valve guide 60 is in contact with the upper surface of the valve seat 48 of the valve casing 42. In this state, the connection protrusions 72*t* of the valve body 70 may be situated above the bottom wall portions 62*b* of the connection recesses 62*m*, and the seal member 76 of the valve body 70 may be pressed against the upper surface of the valve seat 48 of the valve casing 42 by the resilient force of the valve spring 77. In this way, the closing valve 40 may be kept in the fully closed state. The number of steps of the stepping motor 50 in this state may be 0 (zero), and the moving distance in the axial direction (upward direction) of the valve guide 60, i.e., the stroke distance in the valve opening direction, may be 0 mm.

While the vehicle is, for example, parking, the stepping motor 50 of the closing valve 40 may be in a state that it has rotated, for example, by four steps in the valve opening direction from the initialized state. As a result, the valve guide 60 has moved approximately 0.1 mm upwards through the threaded engagement between the male thread portion 54*n* of the output shaft 54 of the stepping motor 50 and the female thread portion 66*w* of the tubular shaft portion 66 of the valve guide 60. Therefore, the valve guide 60 may be raised from the valve seat 48 of the valve casing 42. As a result, it is unlikely that an excessive force is applied between the valve guide 60 of the closing valve 40 and the valve seat 48 of the valve casing 42 even in the case that an environment factor such as temperature is changed.

In this state, the seal member 76 of the valve body 70 may be pressed against the upper surface of the valve seat 48 of the valve casing 42 due to the resilient force of the valve spring 77.

Figure 3:
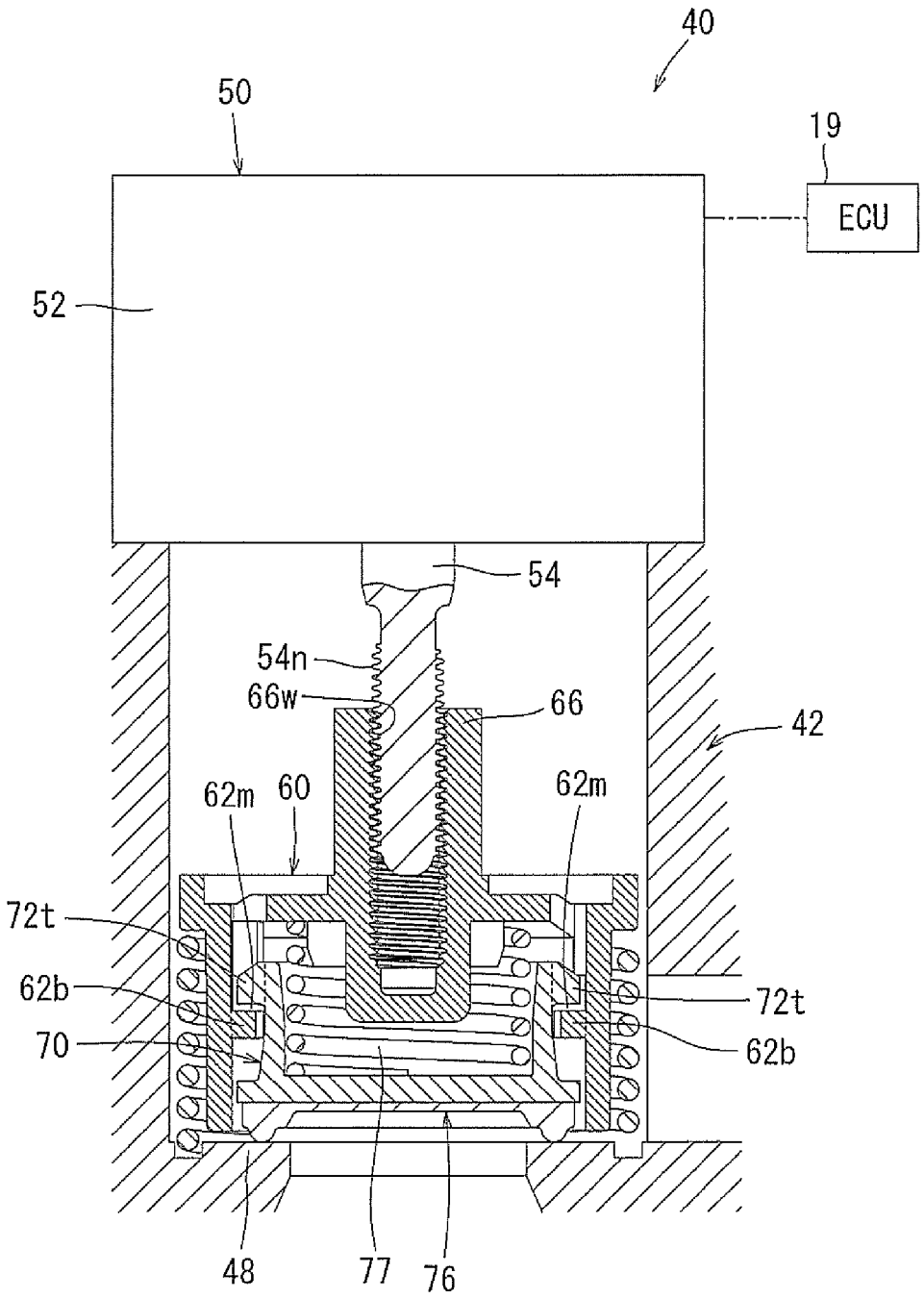
FIG. 3 is a vertical sectional view illustrating the closed state of the closing valve.
Figure 4:
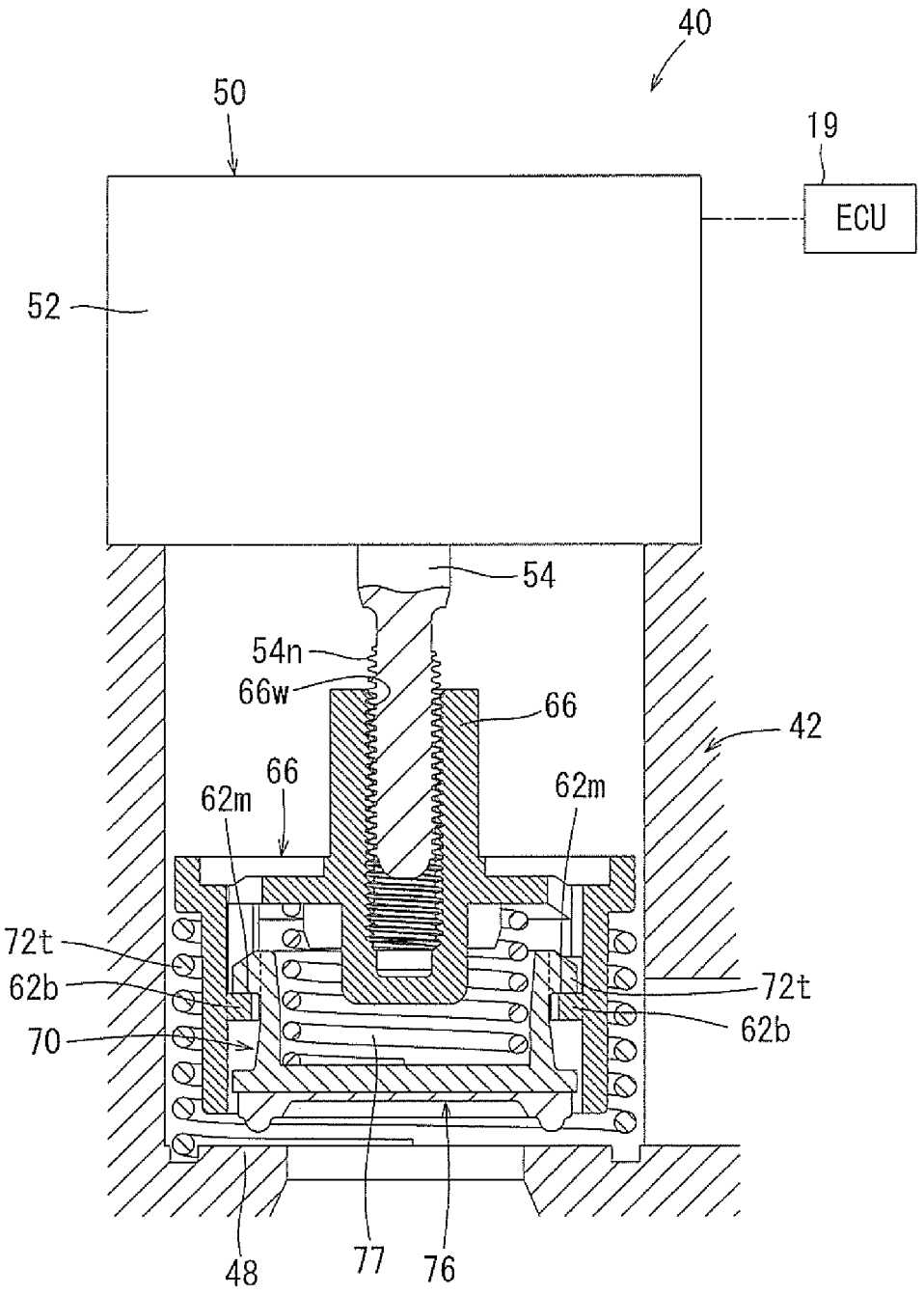
FIG. 4 is a vertical sectional view illustrating the opened state of the closing valve.

If the stepping motor 90 further rotates in the valve opening direction from the position where the stepping motor 50 has rotated by four steps, the valve guide 60 may move upwards through the threaded engagement between the male thread portion 54*n* and the female thread portion 66*w*. Therefore, as shown in FIG. 3, the bottom wall portions 62*b* of the connection recesses 62*m* of the valve guide 60 may be brought to contact the connection protrusions 72*t* of the valve body 70 from below. As the valve guide 60 moves further upwards, the valve body 70 moves upwards together with the valve guide 60 as shown in FIG. 4. Therefore, the seal member 76 of the valve body 70 may be separated from the valve seat 48 of the valve casing 42. As a result, the closing valve 40 may be opened.

The valve opening start position for the closing valve 40 may differ from product to product due to the positional tolerance of the connection protrusions 72*t* formed on the valve body 70 and/or due to the positional tolerance of the bottom wall portions 62*b* formed on the connection recesses 62*m* of the valve guide 60, etc. Therefore, it may be necessary to correctly determine valve opening start positions for different closing valves. This may be achieved through a learning control in which the number of steps for the valve opening start position may be detected based on the time when the inner pressure of the fuel tank 15 is reduced by a predetermined value while the stepping motor 50 of the closing valve 40 is rotated in the valve opening direction (while the number of steps is increased).

In this way, when the closing valve 40 is in the closed state, the valve guide 60 may serve as a movable valve portion, and, when the closing valve 40 is in the open state, the valve guide 60 and the valve body 70 may jointly serve as a movable valve portion.

Figure 5:
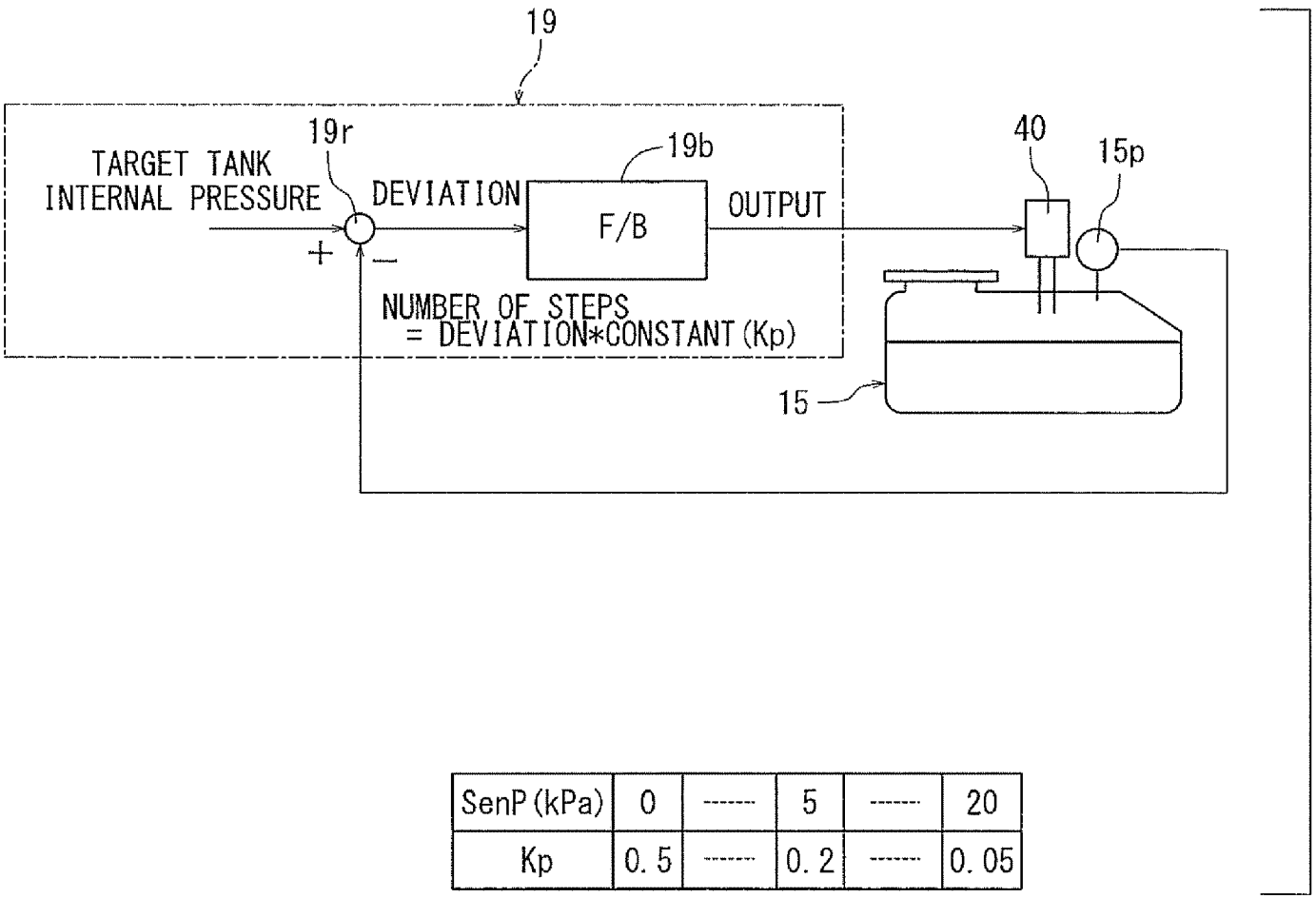
FIG. 5 is a block diagram illustrating a depressurization control device used for the fuel vapor processing apparatus.
Figure 6:
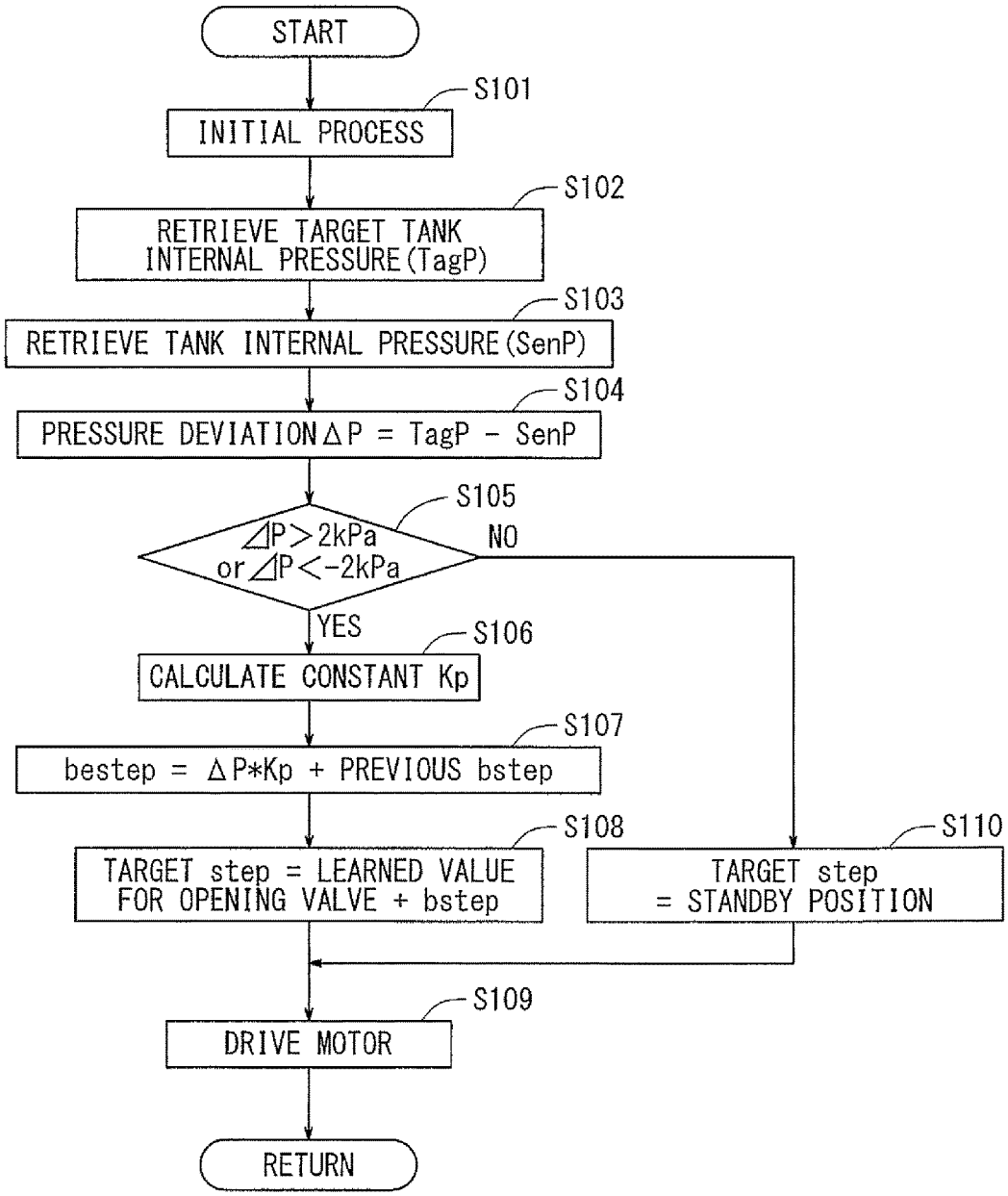
FIG. 6 is a flowchart illustrating the operation of the depressurization control device.

Next, a depressurization control device for the fuel tank 15 using the closing valve 40 will be described with reference to FIGS. 5 and 6. The upper portion of FIG. 5 is a block diagram illustrating the general construction of the depressurization control device. The depressurization control device may be a part of the ECU 19 or may be provided as a separate control device. The depressurization control device may include a feedback control section 19*b*, a target tank internal pressure setting section (not shown), and a comparison section 19*r*. The depressurization control device may be configured to use a tank internal pressure signal that may be input to the ECU 19 from a tank internal pressure sensor 15*p* provided in the fuel tank 15.

According to the depressurization control device, when a target tank internal pressure TagP for the fuel tank 15 is set at the target tank internal pressure setting section of the ECU 19, the target tank internal pressure TagP and the actual tank internal pressure SenP detected by the tank internal pressure sensor 15*p* may be compared with each other at the comparison section 19*r*. Then, a deviation ΔP of the actual tank internal pressure SenP from the target tank internal pressure TagP may be input to the feedback control section 19*b*. At the feedback control section 19*b*, a computation may be performed for determining the stroke distance (the number of steps) of the closing valve 40 necessary for reducing the deviation ΔP. The computation result may then be output to the closing valve 40. More specifically, the computation is made to multiply the deviation ΔP by a preset constant Kp.

The stepping motor 50 of the closing valve 40 may rotate based on an output signal from the feedback control section 19*b* in order to adjust the valve opening position (the degree of valve opening) of the valve body 70 with respect to the valve seat 48. As a result, depressurization is effected for the fuel tank 15, and the actual tank internal pressure SenP may approach to the target tank internal pressure TagP.

Here, as shown in the table at the lower portion of FIG. 5, the constant Kp may be previously set according to the tank internal pressure SenP of the fuel tank 15. For example, if the tank internal pressure SenP is the atmospheric pressure (SenP=0) or around the same, the constant Kp may be set to 0.5. If the tank internal pressure SenP is 5 kPa or around the same, the constant Kp may be set to 0.05. That is, the constant Kp may be of a small value if the tank internal pressure SenP is high, and may be of a large value if the tank internal pressure SenP is low.

Although not shown, if the tank internal pressure SenP is between 0 and 5 kPa, or between 5 and 20 kPa, the constant Kp may be also suitably set according to the value of the tank internal pressure SenP.

Here, if the opening degree of the closing valve 40 is the same, the flow rate of the gas flowing through the closing valve 40 when the tank internal pressure SenP is high may be larger than the flow rate of the gas flowing through the closing valve 40 when the tank internal pressure SenP is low. Therefore, as described above, the constant Kp may be set to be small when the tank internal pressure SenP is high. Hence, the change in the stroke distance (valve opening degree) of the closing valve 40 at the time of feedback control may be small, making it possible to reduce the change of the flow rate of the gas flowing through the closing valve 40. Conversely, the constant Kp may be set to be large when the tank internal pressure SenP is low. Hence, the change in the stroke distance (valve opening degree) of the closing valve 40 may be large, making it easy for the gas to flow through the closing valve 40. In this way, the gas may flow through the closing valve 40 in the same manner irrespective of whether the tank internal pressure SenP is high or low, and the depressurization control for the fuel tank 15 may be performed substantially in the same manner irrespective of whether the tank internal pressure SenP is high or low.

Next, the operation of the depressurization control device for the fuel tank 15 will be described with reference to the flowchart shown in FIG. 6. Here, the process of the flowchart shown in FIG. 6 may be performed simultaneously with the execution of the purge control of the fuel vapor from the canister 22 by the ECU 19 during traveling of the vehicle. That is, the depressurization control for the fuel tank 15 may be performed in conjunction with the opening of the purge valve 26*v* (See FIG. 1) of the purge passage 26. Further, the process of the flowchart shown in FIG. 6 may be repeatedly performed for each predetermined time according to a program that may be stored in a storage device of the ECU 19.

First, in step S101, the learning value (the number of steps) of the valve opening start position for the closing valve 40 may be retrieved, and the unnecessary data may be cleared away (step S101). Next, the target tank internal pressure TagP and the actual tank internal pressure SenP may be retrieved (steps S102 and S103), and the deviation ΔP (=TagP−SenP) may be computed (step S104). Then, it may be determined whether or not the deviation ΔP is out of a predetermined range, for example, whether or not ΔP<−2 kPa, or 2 kPa<ΔP (step S105). In the case where −2 kPa<ΔP<2 kPa ("NO" in step S105), it may be determined that there is no need of the depressurization control for the fuel tank 15, and the stroke distance (the number of steps) of the closing valve 40 may be set to the number of steps corresponding to a standby position (step S110). As a result, the stepping motor 50 of the closing valve 40 may be operated up to the set number of steps, and the closing valve 40 may be kept in the closed state at the standby position (step S109).

Here, the standby position may be a position attained through rotation by eight steps in the closing direction of the stepping motor 50 from the learning value (the number of steps) of the valve opening start position for the closing valve 40. At the standby position, the closing valve 40 may be kept in the closed state in the vicinity of the valve opening start position. Therefore, the closing valve 40 can be quickly opened when a signal for movement in the valve opening direction is received.

If the deviation ΔP is out of a predetermined range (e.g., 2 kPa<ΔP) ("YES" in step S105), the constant Kp may be set based on the tank internal pressure SenP (step S106). Then, the deviation ΔP may be multiplied by the constant Kp, so that the number of steps (bstep) for opening the valve (hereinafter called "bstep") may be obtained (bstep=ΔP*Kp+previous bstep) (step S107). Here, at the first time for processing, the previous bstep may be zero (bstep=0).

In step S108, the learned value of the valve opening start position (the number of steps) and the number of bstep for opening the valve may be added together. Next, the stepping motor 50 of the closing valve 40 may rotate according to the added number of steps (target steps) obtained through the addition of the learned value of the valve opening start position (the number of steps) and the number of bstep (step S109). As a result, the closing valve 40 may be opened from the valve opening start position by a stroke distance that may correspond to the number of bstep.

Due to opening of the closing valve 40, the gas (air containing fuel vapor) in the fuel tank 15 may flow toward the canister 22 via the vapor passage 24 and through the closing valve 40. In this way, depressurization may be effected for the fuel tank 15. As a result, the tank internal pressure SenP may approach to the target tank internal pressure TagP, and the deviation ΔP may decrease. Hereinafter, the flow rate of the gas flowing through the closing valve 40 will be referred to as "depressurization flow rate".

When the depressurization control is being performed, the purge control is also being performed as described above. That is, with the canister 22 communicating with the atmosphere, the purge valve 26*b* may be opened, and the intake negative pressure of the engine 14 may be applied to the interior of the canister 22 via the purge passage 26. Therefore, the fuel vapor having flown into the canister 22 from the fuel tank 15 via the vapor passage 24 may be introduced from the canister 22 to the engine 14 via the purge passage 26 and the purge valve 26*v*.

Second Embodiment

Next, a depressurization control device for the fuel tank 15 according to a second embodiment will be described with reference to FIGS. 7 and 8. As described in connection with the above embodiment, when the depressurization control is being performed, the purge control may be also being performed, so that the canister 22 communicates with the atmosphere, and also communicates with the intake passage 16 of the engine 14 via the purge valve 26*v* and the purge passage 26. According to the second embodiment, the fuel vapor having flown into the canister 22 from the fuel tank 15 via the vapor passage 24 at the time of depressurization control may be prevented from leaking to the atmosphere. In addition, the fuel vapor may be prevented from being adsorbed by the adsorbent in the canister 22 during the purge control. Further, the fuel vapor introduced into the engine 14 may be prevented from adversely affecting the air-fuel ratio of the engine 14. This is because the fuel vapor having flown into the canister 22 from the vapor passage 24 at the time of depressurization control may be introduced into the engine 14 via the purge passage 26 and the purge valve 26*v*.

Figure 7:
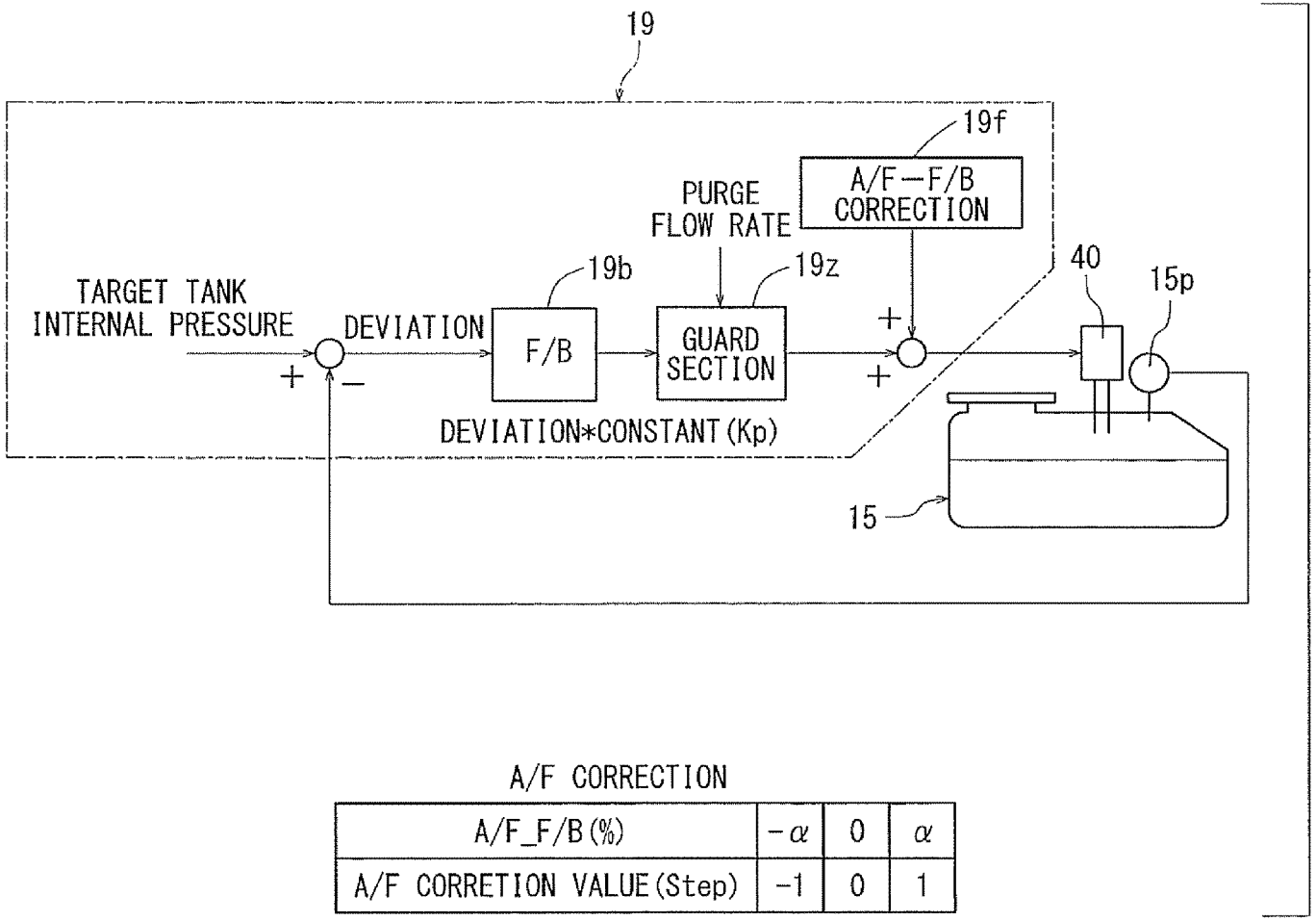
FIG. 7 is a block diagram illustrating a depressurization control device according to a second embodiment.

The depressurization control device according to the second embodiment shown in FIG. 7 is a modification of the depressurization control device of the first embodiment shown in FIG. 5 and configured to enable the above additional functions.

In addition to the components of the depressurization control device shown in FIG. 5 of the first embodiment, the depressurization control device shown in FIG. 7 may include a guard section 19*z* and a correction section 19*f*. The guard section 19*z* may limit the output signal of the feedback control section 19*b* according to a purge flow rate. The correction section 19*f* may make a correction to the output signal according to the air-fuel ratio of the engine 14.

In this specification, the term "purge flow rate" is used to mean the flow rate of the gas flowing from the canister 22 toward the engine 14 via the purge passage 26 during execution of the purge control (see FIG. 1). The ECU 19 may compute the purge flow rate. The guard section 19*z* may limit the output signal of the feedback control section 19*b* so that the flow rate of the gas flowing through the closing valve 40 (depressurization flow rate) may not exceed the purge flow rate.

The correction section 19*f* may correct the output signal of the feedback control section 19*b* according to the air-fuel ratio of the engine 14. More specifically, if the air-fuel ratio is too rich, the correction section 19*f* may correct the output signal of the feedback control section 19*b* so as to reduce the stroke distance (the number of steps) of the closing valve 40. On the other hand, if the air-fuel ratio is too lean, the correction section 19*f* may correct the output signal of the feedback control section 19*b* so as to increase the stroke distance (the number of steps) of the closing valve 40. That is, as shown in the table at the lower portion of FIG. 7, if the air-fuel ratio is too rich (−α), the correction section 19*f* may subtract one step from the output signal of the feedback control section 19*b*. If the air-fuel ratio is too lean (+α), the correction section 19*f* may add one step to the output signal of the feedback control section 19*b*.

Next, the operation of the depressurization control device for the fuel tank 15 according to the second embodiment will now be described with reference to the flowchart shown in FIG. 8. The description of process steps that are similar to those of the process steps in the flowchart of FIG. 6 will be omitted.

Figure 8:
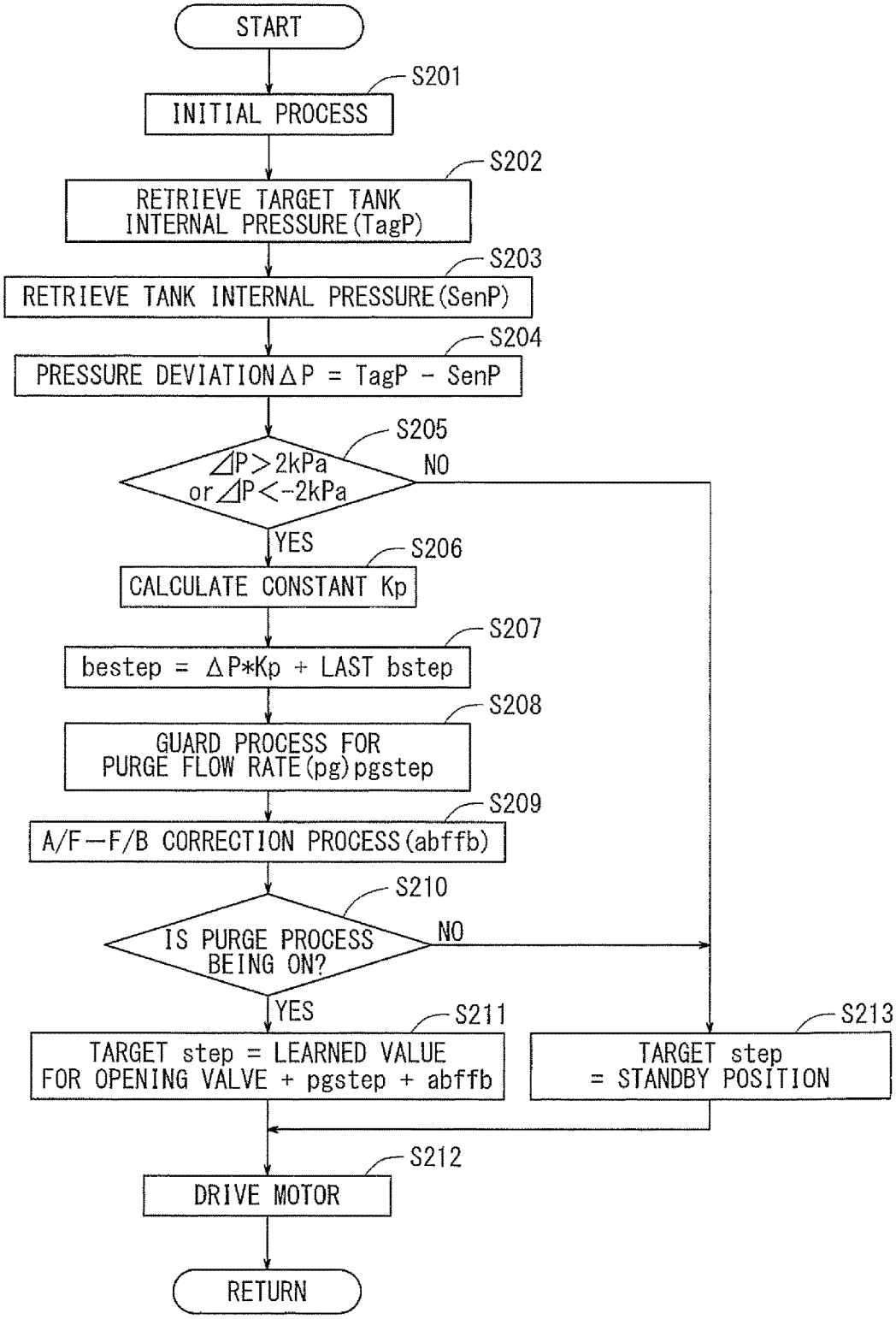
FIG. 8 is a flowchart illustrating the operation of the depressurization control device according to the second embodiment.

In step S205 of FIG. 8, if the deviation ΔP is, for example, in the range: 2 kPa<ΔP ("YES" in step S205), the constant Kp determined based on the tank internal pressure SenP may be multiplied by the deviation ΔP to obtain the number of valve opening steps (bstep) (steps S206 and S207). Next, with the closing valve 40 being opened by the stroke distance corresponding to the number of valve opening steps (bstep), the guard section 19*z* may limit the output signal of the feedback control section 19*b* so that the depressurization flow rate of the gas flowing through the closing valve 40 may not exceed the purge flow rate. That is, the guard process for the purge flow rate may be conducted, and the number of steps (pgstep) after the guard process may be set (step S208).

Here, in the state where the closing valve 40 is opened by the stroke distance corresponding to the number of valve opening steps (bstep), if the depressurization flow rate of the gas flowing through the closing valve 40 does not exceed the purge flow rate, the number of steps (pgstep) after the guard process may be equal to the number of valve opening steps (bstep).

Next, at the correction section 19*f*, the correction value may be set based on the air-fuel ratio of the engine 14 (step S209). That is, if the air-fuel ratio is too rich (−α), the correction value abffb may be set to −1 step; and if the air-fuel ratio is too lean (+α), the correction value abffb may be set to 1 step. If the air-fuel ratio is appropriate, the correction value abffb may be set to 0 steps. Next, in step S210, it may be determined whether or not the purge control is being performed (step S210). If the purge control is being performed ("YES" in step S210), the learning value of the valve opening start position (the number of steps), the number of steps pgstep after the guard process, and the correction value abffb may be added together to set the target number of steps (step S211). Then, the stepping motor 50 for the closing valve 40 may be rotated according to the target number of steps, so that the closing valve 40 may be opened by the stroke distance corresponding to the number of steps obtained through the addition of the number of steps pgstep after the guard processing from the valve opening start position and the correction value abffb (step S212).

In this way, the flow rate of the gas flowing through the closing valve 40 (depressurization flow rate) may be controlled so as not to exceed the purge flow rate. Therefore, the fuel vapor having flown into the canister 22 from the fuel tank 15 via the vapor passage 24 at the time of depressurization control may not stay in the canister 22 but may be introduced into the engine 14 via the purge passage 26 and the purge valve 26*v*. Further, the fuel vapor within the canister 22 may be prevented from leaking to the atmosphere.

If the air-fuel ratio of the engine 14 is too rich (−α), the correction value abffb may be set to −1 step, and the number of steps pgstep after the guard process may be reduced by one step, so that the opening degree of the closing valve 40 may become smaller. Thus, the amount of the fuel vapor introduced into the intake passage 16 of the engine 14 from the fuel tank 15 via the vapor passage 24, the canister 22, and the purge passage 26 may be reduced, and the air-fuel ratio may be restored to an appropriate value.

According to the fuel vapor processing apparatus 20 of the second embodiment, when performing the depressurization control for the fuel tank 15, the stroke distance (the number of steps) of the closing valve 40 may be feedback-controlled such that the deviation ΔP of the actual tank internal pressure SenP from the target tank internal pressure TagP of the fuel tank 15 is reduced. Thus, if the actual tank internal pressure SenP is higher than the target inner tank pressure TagP, the stroke distance may be controlled so as to open the closing valve 40. As a result, the gas containing fuel vapor and produced in the fuel tank 15 may be allowed to flow toward the canister 22 via the vapor passage 24, so that depressurization may be effected for the fuel tank 15. In this way, depressurization of the fuel tank 15 may be conducted through feed-back control, so that a complicated control process is not necessary.

Further, the closing valve 40 may be so constructed that the flow rate of the gas flowing through the vapor passage 24 (depressurization flow rate) can be adjusted through changing of the distance along the axis of the valve body 70 with respect to the valve seat 48, so that it is possible to perform fine adjustment of the flow rate of the gas flowing through the vapor passage 24. Thus, the depressurization control for the fuel tank 15 can be performed with high accuracy.

If the deviation ΔP of the actual tank internal pressure SenP from the target tank internal pressure TagP of the fuel tank 15 is within a predetermined range, the closing valve 40 may be kept at the standby position that may place the fuel tank 15 in a closed state. In this case, no feedback control may be performed. Thus, the depressurization control may be prevented from being conducted in the event that a fine change in the tank internal pressure SenP is caused due to fluctuation in the fuel level in the fuel tank 15. Further, the closing valve 40 may be kept in the closed state in the vicinity of the valve opening start position, so that it is possible to quickly open the valve when the feedback control is necessary to be conducted.

The constant Kp of the feedback control section 19*b* may be set so as to be small when the tank internal pressure SenP is high, and large when the tank internal pressure SenP is low. Therefore, the gas may flow through the closing valve 40 in the same fashion irrespective of whether the tank internal pressure SenP is high or low. In this way, it is possible to perform the depressurization control for the fuel tank 15 substantially in the same manner irrespective of whether the tank internal pressure SenP is high or low.

If the purge passage 26 is closed, no depressurization control is performed for the fuel tank 15. Therefore, the canister 22 may not be filled up with the fuel vapor flown from within the fuel tank 15.

Further, there may be provided an upper limit value to the stroke distance of the closing valve 40 so that the flow rate of the gas flowing through the closing valve 40 (depressurization flow rate) may not exceed the purge flow rate. Therefore, the fuel vapor having flown into the canister 22 from the fuel tank 15 via the vapor passage 24 may not stay in the canister 22 but may be introduced into the intake passage 16 of the engine 14 via the purge passage 26.

If, for example, the air-fuel ratio of the engine 14 is too rich, the stroke distance of the closing valve 40 may be corrected to reduce the opening degree of the closing valve 40, making it possible to reduce the amount of the fuel vapor supplied to the intake passage 16 of the engine 14 from the fuel tank 15 via the vapor passage 24, the canister 22, and the purge passage 26. Conversely, if the air-fuel ratio is too lean, the stroke distance of the closing valve 40 may be corrected to increase the opening degree of the closing valve 40, making it possible to increase the amount of the fuel vapor supplied to the intake passage 16 of the engine 14 from the fuel tank 15 via the vapor passage 24, the canister 22, and the purge passage 26. As a result, it is possible to maintain the air-fuel ratio of the engine at an appropriate level.

Other Possible Modifications

The above embodiments may be modified in various ways. For example, although the depressurization of the fuel tank 15 is always effected through feedback control in the embodiments described above, it may be possible to additionally provide such a control that the closing valve 40 is forcibly opened to a degree close to the fully opened state, for example, when the pressure of the fuel tank 15 is brought to approach the upper-limit pressure during the feedback control.

Further, although the stepping motor 50 is used for the closing valve 40 in the above embodiments, it may be possible to use a DC motor or the like instead of the stepping motor 50.

What is claimed is:

1. A fuel vapor processing apparatus comprising:

a canister configured to be capable of adsorbing fuel vapor produced in a fuel tank;

a closing valve provided in a vapor passage connecting the canister and the fuel tank, the closing valve comprising a valve seat, a movable valve member movable relative to the valve seat in an axial direction, and an actuator coupled to the movable valve member;

a purge passage connecting the canister and an intake passage of an engine; and a control device coupled to the actuator and configured to perform a depressurization control, in which a stroke distance of the movable valve member of the closing valve in the axial direction is changed with respect to a reference position, so that a positive, non-zero flow rate of a gas flowing through the vapor passage from the fuel tank is adjusted to reduce a pressure within the fuel tank;

wherein the depressurization control consists of a feedback control that repeatedly performs at predetermined time intervals an operation changing the stroke distance of the movable valve member of the closing valve such that a deviation of an actual tank internal pressure from a target tank internal pressure of the fuel tank becomes smaller, thereby adjusting a flow rate of gas flowing through the vapor passage; and wherein the control device is configured to perform the depressurization control, including the feedback control, when the purge passage is open such that the canister is in fluid communication with the intake passage.

2. The fuel vapor processing apparatus according to claim 1, wherein:

the closing valve is configured such that the movable valve member contacts the valve seat to close the closing valve for keeping the fuel tank in a closed state when the stroke distance is between zero and a predetermined value, the movable valve member being positioned at a valve open start position when the stroke distance is the predetermined value; and if the deviation between the target tank internal pressure of the fuel tank and the actual tank internal pressure is within a predetermined range, the control device sets the stroke distance to a value that is larger than zero and smaller than the predetermined value for the valve open start position, so that the movable valve member is positioned at a standby position for keeping the fuel tank in the closed state.

3. The fuel vapor processing apparatus according to claim 1, wherein:

the stroke distance of the movable valve member of the closing valve is set based on a value that is obtained by multiplying the deviation of the actual tank internal pressure received from a pressure sensor, from the target tank internal pressure by a constant; and the constant has a first value when the actual tank internal pressure is a first pressure;

the constant has a second value when the actual tank internal pressure is a second pressure;

the second value is larger than the first value if the second pressure is smaller than the first pressure, and the second value is smaller than the first valve if the second pressure is larger than the first pressure.

4. The fuel vapor processing apparatus according to claim 1, wherein:

the movable valve member of the closing valve is kept at a standby position for keeping the fuel tank in the closed state when the purge passage connecting the canister and the intake passage of the engine is being closed.

5. The fuel vapor processing apparatus according to claim 1, wherein:

the stroke distance of the movable valve member of the closing valve is determined not to exceed an upper limit value, so that the flow rate of the gas flowing through the closing valve does not exceed a purge flow rate of the gas flowing through the purge passage connecting the canister and the intake passage of the engine.

6. The fuel vapor processing apparatus according to claim 1, wherein:

the actuator comprises a stepping motor.

7. The fuel vapor processing apparatus according to claim 1, wherein:

the feedback control includes increasing and decreasing the stroke distance of the movable valve member of the closing valve.

8. The fuel vapor processing apparatus according to claim 1, further comprising a purge valve provided in the purge passage;

wherein the control device is further configured to control the purge valve such that the purge valve is open when the depressurization control is performed.

9. The fuel vapor processing apparatus according to claim 8, wherein the control device is further configured such that:

the closing valve and the purge valve are kept in the closed state while a vehicle is parking; and if a predetermined purge condition is satisfied while the vehicle is travelling, the purge valve is opened to perform a purge operation and the closing valve is controlled to perform the depressurization control at the same time the purge operation is performed.

10. The fuel vapor processing apparatus according to claim 8, further comprising an atmospheric passage communicating the canister with the atmosphere, wherein the canister is in communication with the atmosphere via the atmospheric passage during the depressurization control.

* * * * *